United States Patent [19]

Fujita et al.

[11] Patent Number: 4,565,112

[45] Date of Patent: Jan. 21, 1986

[54] BOLT TIGHTENING APPARATUS HAVING BOLT TIP DISCHARGING DEVICE

[75] Inventors: Masahiro Fujita, Sennan; Yukio Uemura, Yokohama, both of Japan

[73] Assignees: Maeda Metal Industries, Ltd., Osaka; Nissan Motor Co., Ltd., Kanagawa, both of Japan

[21] Appl. No.: 624,177

[22] Filed: Jun. 25, 1984

[30] Foreign Application Priority Data

Jun. 25, 1983 [JP] Japan ..... 58-98297[U]

[51] Int. Cl.[4] ..... B25B 17/00

[52] U.S. Cl. ..... 81/56

[58] Field of Search ..... 81/55, 56, 124.1

[56] References Cited

U.S. PATENT DOCUMENTS 3,041,902 7/1962 Wing ..... 81/56

4,106,371 8/1978 Akiyoshi et al. ..... 81/124.1 X 4,403,529 9/1983 Ikeda et al. ..... 81/56

4,503,736 3/1985 Fushiya et al. ..... 81/55

*Primary Examiner*—James G. Smith

[57] ABSTRACT

A bolt tightening apparatus having a bolt tip discharging device and comprising an epicyclic train, an inner socket and an outer socket which are removably in engagement with the epicyclic train, an ejector pin having a rear end positioned in the vicinicty of the planet gear support frame of the train, the epicyclic train being formed with a stepped axial bore in alignment with the ejector pin, a clamp shaft axially slidably disposed in the axial bore and having a pin bore coaxial therewith and a clamp portion, the clamp portion being engageable with the stepped portion of the train defining the axial bore to clamp the ejector pin when the pin is inserted into the pin bore, and a lever coupled to the clamp shaft for retracting the shaft to release the ejector pin from the clamp portion.

3 Claims, 12 Drawing Figures

BOLT TIGHTENING APPARATUS HAVING BOLT TIP DISCHARGING DEVICE

TECHNICAL FIELD

The present invention relates to improvements in a bolt tightening apparatus, and more particularly to an apparatus which is adapted to tighten a bolt having a tip to completely tighten up the bolt with a predetermined torque upon shearing the bolt tip and which includes a device for discharging the sheared bolt tip from the apparatus.

BACKGROUND ART

Conventional apparatus for tightening up a bolt B having at its forward end a tip T which is to be sheared includes an inner socket 200 engageable with the bolt tip T and an outer socket 180 engageable with a nut N (FIG. 8). The two sockets are coupled to an epicyclic train and thereby subjected to the reaction of rotation to tighen up the bolt B and shear the tip T at a circumferential groove C of the bolt B. The tip remaining in the inner socket 200 is knocked out by an ejector pin 240 disposed in the inner socket.

The ejector pin extends rearward through the sun gear of the epicyclic train and has a rear end in engagement with a discharging lever. The ejector pin is retained in a retracted position or allowed to advance when released by manipulating the lever.

However, when the ejector pin is as long as the entire length of the tightening apparatus as in the conventional apparatus, the following problem is encountered.

To give an increased force of inertia when projected, the ejector pin 240 has a thick front end portion 240*a*. Because the junction between the thick portion 240*a* and the other slender portion 240*b* is prone to cracking due to the impact of projection, there arises a need to replace the ejector pin. Nevertheless, the ejector pin, extending through the epicyclic train, is not removable easily but requires a cumbersome procedure for replacement.

SUMMARY OF THE INVENTION

An object of the present invention is to provide a bolt tightening apparatus having an ejector pin which is easily replaceable.

More specifically, an object of the invention is to provide a bolt tightening apparatus including an ejector pin which can be repalced merely by separating an outer socket and an inner socket from an epicyclic train.

The present invention provides a bolt tightening apparatus which comprises an epicyclic train having a planet gear support frame, an inner socket and an outer socket which are engageable with and removable from the epicyclic train, and an ejector pin having a rear end positioned in the vicinity of the support frame. The support frame is formed with a stepped axial bore extending therethrough in alignment with the ejector pin. An axially slidable clamp shaft has a clamp portion disposed in the axial bore and having a pin bore formed coaxially therewith. The clamp portion is engageable with the stepped portion defining the axial bore to clamp the ejector pin when the ejector pin is inserted into the pin bore. The clamp shaft is coupled to a lever for retracting the clamp shaft to release the ejector pin from the clamp portion.

A bolt tip, when inserted into the inner socket, pushes the ejector pin rearward, fitting the rear end of the pin into the pin bore of the clamp shaft for clamping. Thus, the ejector pin is held in a retracted position. The lever, when pulled, retracts the clamp shaft, releasing the ejector pin from the shaft to project the pin forward, whereby the bolt tip is knocked out from the inner socket.

BRIED DESCRIPTION OF THE DRAWINGS

DETAILED DESCRIPTION OF THE INVENTION

Figures 1, 8:
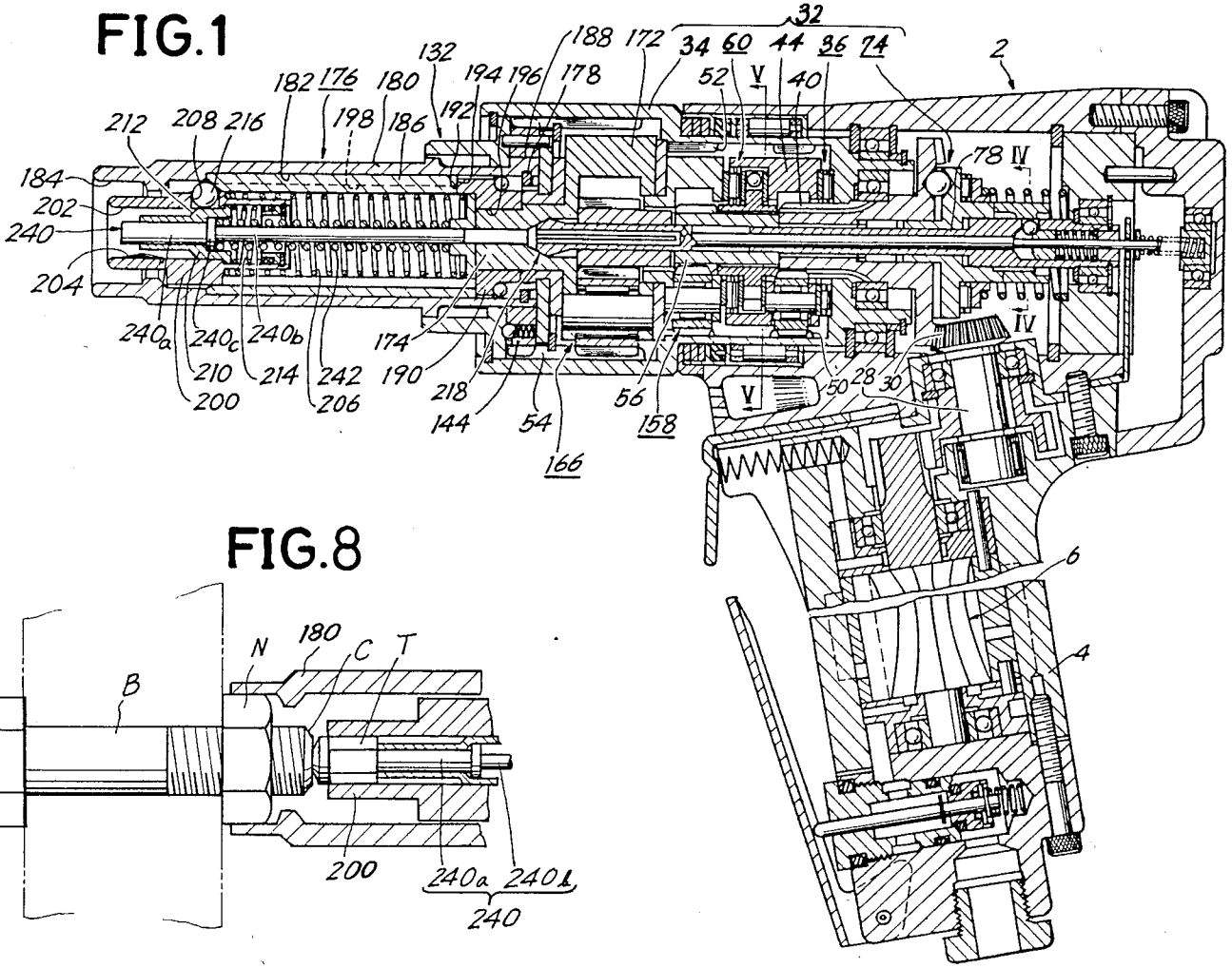
FIG. 1 is a sectional view showing the bolt tightening apparatus of the invention.
FIG. 8 is a sectional view of a bolt and a nut in engagement with the socket unit.

The tightening apparatus comprises a housing 2 including a grip portion 4, a drive assembly 6, such as an air motor, housed in the grip portion 4, a speed change assembly 32 provided in the housing 2 and partly exposed from the front open end of the housing, and a socket unit 176 removably connected to the speed change assembly 32 and including an inner socket 200 and an outer socket 180 engageable with the tip T of a bolt B and a nut N, respectively. The drive assembly 6 is coupled to the speed change assembly by a transmission shaft 28.

The components of the apparatus will be described.

SPEED CHANGE ASSEMBLY

The speed change assembly 32 has a tubular internal gear 34 rotatably fitted in the open front end of the housing 2. Arranged within the gear 34 are a main epicyclic train 36, an output shaft 56 aligned with a sun gear 40 of the train 36, clutch means 74 for coupling the output shaft 56 to the sun gear 40, and a one-way clutch 60 provided between a planet gear support frame 44 and the output shaft 56 for permitting the rotation of the sun gear 40 in preference. When required as in the present embodiment, one or more auxiliary epicyclic trains 158 and 166 are coupled to the output shaft 56 in series therewith.

The planet gears 42, 162, 170 of the epicyclic trains 36, 158, 166 are in mesh with inner teeth 50, 52, 54 formed on the inner surface of the internal gear 34.

Figure 2:
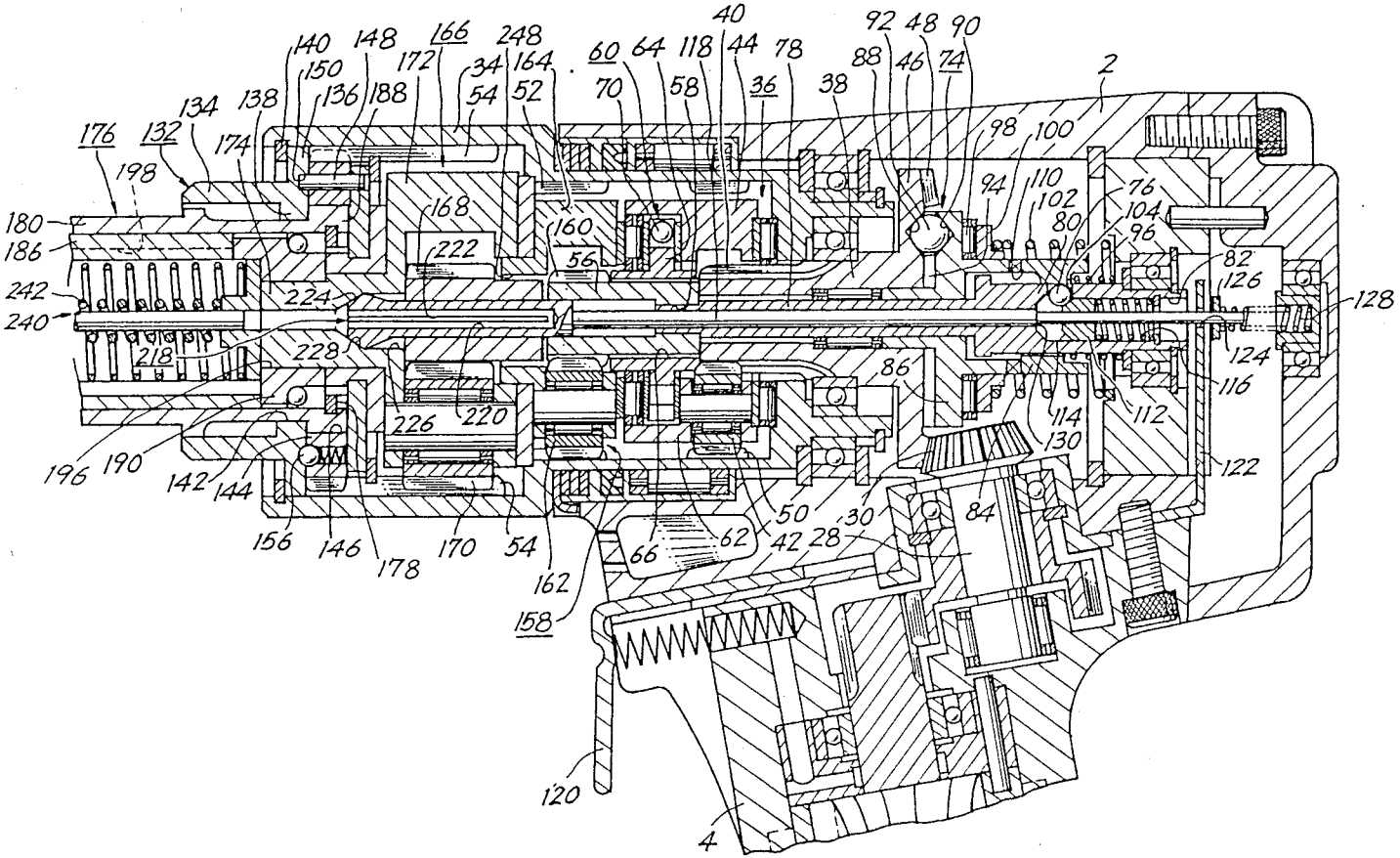
FIG. 2 is a fragmentary sectional view showing the bolt tighening apparatus.

As seen in FIG. 2, a main shaft 38 is supported by the base end of the internal gear 34, the forward end of which is formed with the sun gear 40 of the main epicyclic train 36. The main shaft 38 has a flange 46 at its base end. A bevel gear 48 formed along the outer periphery of the flange 46 is in mesh with a bevel gear 30 on the transmission shaft 28.

ONE-WAY CLUTCH

Figure 5:
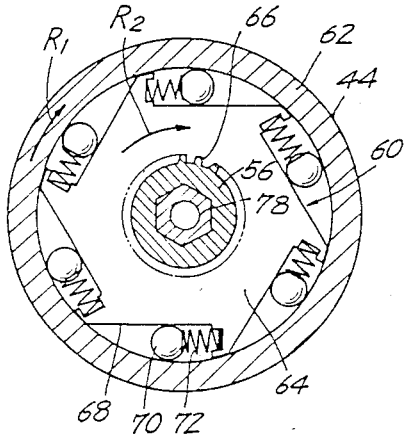

The one-way clutch 60 for disconnectably coupling the support frame 44 to the output shaft 56 comprises a rotary member 64 disposed in an annular wall 62 extending from an end of the support frame 44 axially thereof as seen in FIGS. 2 and 5. The rotary member 64 is splined to the output shaft 56 as at 66 so as to be slidable on and rotatable with the shaft 56.

The rotary member 64 is equidistantly cut out as at 68 tangentially of its outer periphery. A ball 70 and a spring 72 for biasing the ball 70 toward the annular wall 62 are disposed in each cutout 68. The annular wall 62 is rotated at a reduced speed in the direction of arrow R1 by the epicyclic train 36. The output shaft 56 is fitted to a clutch shaft 78 having the polygonal shaft portion to be described later and is driven in the direction of arrow R2. While the speed change assembly is subjected to no load, $R2>R1$, permitting the shaft 78 to advance in rotation relative to the annular wall 62 which idly rotates free of the output shaft 56. The output shaft 56 rotates with the shaft 78 at a speed R2.

When the shaft 78 becomes free to rotate, i.e. $R2=0$, with a load acting on the speed change assembly, the annular wall 62 comes into engagement with the rotary member 64 to rotate therewith, consequently driving the output shaft 56 at the reduced speed R1.

CLUTCH MEANS

Figure 3A:
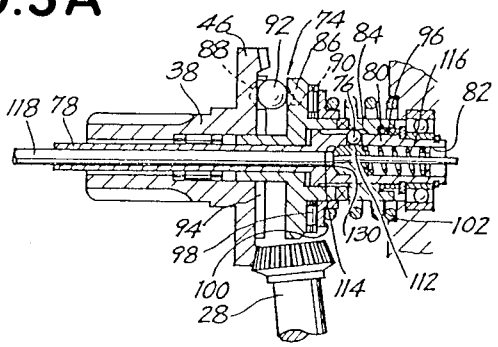
FIGS. 3A and 3B are views showing the operation of a clutch in sequence.
Figure 3B:
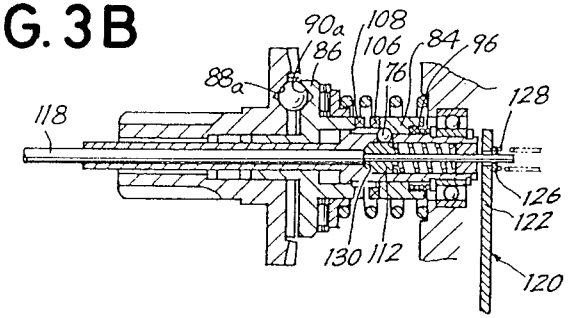

With reference to FIGS. 2, 3A and 3B, the clutch shaft 78 extends through the axis of the main shaft 38 and is freely rotatably independently of the main shaft. The shaft 78 has at each end thereof a polygonal shaft portion extending outward from the main shaft 38. The forward end of the shaft 78 is engaged in a hexagonal bore 58 formed in the rear end of the output shaft 56 coaxially therewith. The hexagonal shaft portion 80 at the rear end of the shaft 78 has an increased diameter and is formed with a bore 82 extending forward from its rear end face.

A slide tube 84 is fitted around the hexagonal shaft portion 80 of the clutch shaft 78 and is slidable thereon. A clutch plate 86 interposed between the slide tube 84 and the flange 46 of the main shaft 38 is freely rotatable on the clutch shaft 78 independently of the shaft 78. Conical cavities 88 and 90 are formed in the opposed faces of the flange 46 and the clutch plate 86, respectively, and are arranged equidistantly on the same phantom circle in opposed relation. A ball 92 is fitted in each pair of opposed cavities 88 and 90. These balls 92 are rollably supported by a ball cage 94 fitted around a tubular portion of the clutch plate 86.

The clutch plate 86 is biased toward the main shaft 38 by a spring 102 through a thrust bearing 98 and a holding plate 100.

As seen in FIG. 3B, the clutch plate 86 and the slide tube 84 have toothed edges 108 and 106 opposed to each other. The slide tube 84 is biased toward the clutch plate 86 by a spring 96, whereby the two toothed edges 106 and 108 are engaged with each other as shown in FIG. 2.

Holes 104 are formed in the wall of the hexagonal shaft portion 80 of the clutch shaft 78. A ball 76 having a diameter larger than the thickness of the wall is rotatably fitted in each hole 104. An escape recess 110 for the ball 76 to partly fit in is formed inside the slide tube 84 and extends approximately from its center portion toward the clutch plate 86.

A slide block 112 slidably fitted in the bore 82 in the hexagonal shaft portion 80 of the clutch shaft 78 is biased toward the main shaft 38 by a spring 116. The balls 76 bear on a tapered face 114 formed at the front end of the block 112.

A clamp shaft 118 rotatably and slidably extends through the clutch shaft 78 and the slide block 112 coaxially therewith.

The front end of the shaft 118 has an increased diameter and provides a clamp portion 218 for the ejector pin 240 to be described later. The rear end of the shaft 118 has a reduced diameter and is connected to a trigger lever 120 and biased forward by a spring 128.

The trigger lever 120 is formed from a metal strip by bending. The lever is bent in an arcuate form within the grip portion 4 to clear the transmission shaft 28 and further bent upward to provide a base end. The clamp shaft 118 extends through a hole 124 formed in the upper end of the bent portion 122.

The clamp shaft 118 is provided with a snap ring 126, which engages with the lever 120 when the lever 120 is pulled. When the lever 120 is pulled, a stepped portion 130 of the clamp shaft 118 toward its rear end moves the slide block 112 rearward against the spring 116.

EPICYCLIC TRAINS FOR SPEED REDUCTION

The front portion of the output shaft 56 serves as the sun gear 160 of the first auxiliary epicyclic train 158. The sun gear 168 of the second auxiliary epicyclic train 166 is disposed to the front of the sun gear 160 in alignment therewith.

A support frame 164 supporting the planet gears 162 of the first auxiliary epicyclic train 158 is splined as at 248 to the sun gear 168 of the second auxiliary train 166. A support frame 172 for the planet gears of the second auxiliary train 166 is provided with a polygonal engaging shaft 174 in alignment with the sun gear 168.

The rotation of the output shaft 56 is subjected to speed reduction by the first and second epicyclic trains 158 and 166. A socket holder 132 is attached to the forward end opening of the internal gear 34.

SOCKET HOLDER

As seen in FIG 2, the socket holder 132 comprises a main body 134 formed with outer and inner flanges 136 and 138 at its rear end. The rear end of the holder main body 134 is rotatably fitted in the tubular case 34. A gear 144 is slidable on the base end face of the main body 134. The main body 134 is prevented from slipping off the internal gear 34 by a snap ring 140.

Figure 6A:
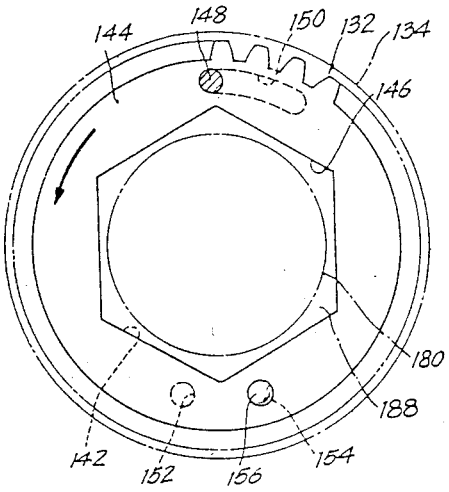
FIGS. 6A and 6B are views showing how a socket unit is installed in palce.

The inner periphery of the inner flange 138 of the holder main body 134 defines a hexagonal hole 142 as shown in FIG. 6A.

The gear 144 is in mesh with an extension of the inner gear 54 meshing with the planet gears 170 of the second auxiliary epicyclic train 166.

The gear 144 is coaxially formed with a hexagonal hole 146 which is adapted to be in register with the hexagonal hole 142 of the socket holder 132.

A stopper pin 148 projecting from the gear 144 is slidably fitted in a circular arc groove 150 formed in the holder main body 134. The groove 150 is formed on a circle centered about the axis of the holder 132 and has a length equal to 1/12 of the circumference of the circle. Two conical cavities 152 and 154 are formed in the rear end of the holder main body in diametrically opposed relation to opposite ends of the circular groove 150. The gear 144 has a spring-biased click ball 156 which is engageable with the cavities.

The socket unit 176 is removably attached to the socket holder 132.

SOCKET UNIT

The socket unit 176 comprises the outer socket 180, inner socket 200 and ejector pin 240. The unit is connectable to and removable from the holder 132.

As seen in FIG. 1, the outer socket 180 has a bore 182 coaxially extending therethrough and a nut engaging bore 184 at its front end and is freely rotatably provided in its interior with an inner socket holder 186 and a transmission tube 190, which is disposed at the base end of the holder 186 and prevented from slipping off by a snap ring 178.

The outer socket 180 is formed at its base end with a hexagonal flange 188 which is removably fitted in the hexagonal holes 142 and 146 of the holder main body 134 and the gear 144.

The inner socket holder 186 and the transmission tube 190 have toothed edges 192 and 194 opposed to and engaged with each other.

The tube 190 is coaxially formed with a polygonal bore 196 having removably engaged therein the engaging shaft 174 of the support frame 172 of the second auxiliary epicyclic train 166. The inner socket holder 186 is internally formed with axial spline grooves 198. The inner socket 200 is slidably in engagement with the grooves 198.

The inner socket 200 is formed in its front end with a tip engaging bore 202 for the bolt tip T to engage in and is biased forward by a spring 206.

The engaging bore 202 is provided with a plate spring 204 for preventing the bolt tip T from spontaneously falling off after the tip has been snapped off. The force of the spring is such that the spring 204 can retain the bolt tip against gravity while permitting the discharge of the tip without trouble.

The inner socket 200 is provided with known incomplete fitting prevention means.

To provide the preventing means, a hole 208 is formed in the wall of the inner socket 200. A ball 216 rollably fitted in the hole 208 has such a size as to project outward from the tubular wall of the socket 200. A tip insertion recognizing tube 210 is slidably fitted in the inner socket 200.

The insertion recognizing tube 210 has a small-diameter front portion and a large-diameter rear portion, with a tapered stepped portion 212 formed therebetween, and is biased toward the front end of the outer socket 180 by a spring 214. The ball 216 is pushed up outward by the large-diameter portion of the tube 210 into contact with the front end of the inner socket holder 186, whereby the inner socket 200 is prevented from retraction.

The ejector pin 240 of the socket unit 176 slidably extends through the tip insertion recognizing tube 210. The pin 240 has an enlarged head **240*a* at its shank 240*b* and a flange for preventing the pin 240 from slipping off from the tube 210. The ejector pin 240 is biased by a spring 242 toward the front end of the outer socket 180, with its head 240*a* projecting outward beyond the tube 210, and has a rear end extending to a position close to the engaging shaft 174 of the support frame 172 of the epicyclic train 166**.

Figure 6B:
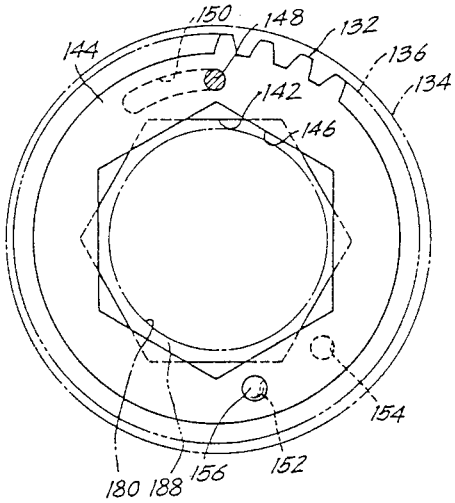

To attach the socket unit 176 to the holder 132, the hexagonal holes 142 and 146 of the socket holder main body 134 and the gear 144 are registered with each other as seen in FIG. 6A, the hexagonal flange 188 of the outer socket 180 is fitted into the holes 142, 146, and the holder main body 134 is rotated in the direction of arrow shown, whereby the hexagonal flange 188 of the outer socket 180 is brought out of register with the hexagonal hole 142 in the holder main body 134 as seen in FIG. 6B. This prevents the outer socket 180, accordingly the socket unit 176, from slipping off. Since the spring-biased click ball 156 engages in the conical cavity 152 of the socket main body 134 to moderately engage the holder 132, the hexagonal flange 188 of the outer socket 180 will not spontaneously come into register with the hexagonal hole 142 of the main body 134 during tightening, whereby the unit 176 is prevented from slipping off inadvertently.

The clamp portion 218 formed at the front end of the clamp shaft 118 is adapted to releasably support the ejector pin 240.

CLAMP PORTION

The front end of the clamp shaft 118 is formed with a tapered face 224 and fitted in a base-end large-diameter portion of a stepped axial bore 226 extending through the support frame 172 of the second auxiliary epicyclic train 166.

The stepped portion of the axial bore 226 is defined by a tapered face 228 corresponding to the tapered face 224 of the clamp shaft 118.

The clamp shaft 118 is coaxially formed with a pin bore 220 opened at its front end and has slits 222 in communication with the pin bore 220. The clamp shaft 118 is spring-biased toward the outer socket 180 into contact with the tapered face 228 defining the axial bore 226 of the support frame 172, whereby the pin bore 220 is diametrically contracted.

When the trigger lever 120 is pulled to rearwardly move the clamp shaft 118 against the spring 128 away from the tapered face 228 defining the axial bore 226, the slits 222 and the pin bore 220 enlarge to permit advance of the ejector pin 240 into the bore 220.

The tightening apparatus described above operates in the following manner.

ENGAGEMENT OF NUT AND BOLT

A nut is first loosely screwed on a bolt manually. With the tightening apparatus placed on the bolt, the bolt tips T is fitted into the tip engaging bore 202.

At this time, the ejector pin 240 and the recognizing tube 210 in the inner socket 200 retract against the springs 214 and 242. When the bolt tip T has completely fitted into the bore 202, the ball 216 of the incomplete fitting prevention means falls from the tapered portion 212 of the tube 210 onto the small-diameter portion, permitting retraction of the inner socket 200 from the nut engaging bore 184 of the outer socket 180. The nut N therefore fits into the bore 184.

At this time, the ejector pin 240 rearwardly pushes the clamp portion 218 of the clamp shaft 118, moving the tapered face 224 of the clamp portion 218 away from the tapered face 228 of the support frame 172. This enlarges the pin bore 220 of the clamp portion 218, allowing the rear end of the ejector pin 240 to advance into the enlarged pin bore 220, whereby the shaft 118 has its tapered face 224 brought into contact with the tapered face 228 of the support frame 172 again by the action of the spring 228. Consequently the pin bore 220 is diameterically contracted for the clamp portion 218 to clamp the ejector pin 240.

TIGHTENING

The drive assembly 6, when operated, causes the transmission shaft 28 to rotate the main shaft 38 at a high speed.

The main shaft 38 is coupled to the clutch plate 86 by the balls 92 fitting in the conical cavities 88 and 90, and the clutch plate 86 rotates with the slide tube 84 by virtue of the engagement between the toothed edges 108 and 106. Further since the slide tube 84 has fitted therein the hexagonal shaft portion 80 of the clutch shaft 78, the rotation of the main shaft 38 is delivered to the clutch shaft 78.

Although the support frame 44 and the annular wall 62 of the main epicyclic train 36 coupled to the main shaft 36 rotate simultaneously with the above rotation at the reduced speed R1, $R1<R2$, so that the rotation of the annular wall 62 is made independent of the output shaft 56 by the one-way clutch 60. Thus, the rotation R2 of the main shaft 38 is delivered through the clutch shaft 78 directly to the output shaft 56 which is splined to the shaft 78 as at 66.

On the other hand, the sun gear 40 at the front end of the main shaft 38 causes the support frame 44 to rotate at the reduced speed R1.

The support frame 44 and the output shaft 56 are coupled together by the one-way clutch 60 which permits the rotation of the output shaft 56 in preference, and the rotation transmitted to the output shaft 56 is directly applied to the first auxiliary epicyclic train 158, giving an increased torque of reduced speed to the planet gear support frame 164 of the train 158.

The torque of the support frame 164 is fed to the second auxiliary epicyclic train 166 to which the frame 164 is splined as at 248, giving a further increased torque of lower speed to the support frame 172 of the train 166.

The rotation of the support frame 172 is delivered to the inner socket 200 via the transmission tube 190 and the inner socket holder 186 of the socket unit 176.

Further torque acting in an opposite direction to the rotation of the inner socket 200 develops in the inner gears 50, 52, 54 in mesh with the planet gears 42, 162, 170 of the trains 36, 158, 166. With the bolt tip T held by the inner socket 200, this causes the outer socket 180 to rotate the nut N at a relatively high speed to quickly tighten the nut on the bolt.

TIGHTENING UP AND SHEARING

When the nut is tightly screwed on the bolt, abruptly increasing resistance acts on the rotary drive system, and the resistant force of the clutch shaft 78 exceeds the force of the spring 102, with the result that each ball 92 moves out of the conical cavities 88, 90 of the main shaft 38 and the clutch plate 86 as shown in FIG. 3A, compressing the springs 102 and 96 to push the clutch plate 86 and the slide tube 84 rearward. At this time, the escape recess 110 in the slide tube 84 is positioned as opposed to each ball 76 on the clutch shaft 78, such that the ball 76 is pushed out and fitted into the escape recess 110 by the slide block 112, permitting the slide block 112 to advance and the ball 76 to ride onto the slide block 112. The slide block 112 is advanced by the action of the spring 116, preventing the return of the balls 76 to the original position.

With the main shaft 38 in rotation at all times, the balls 92 between the main shaft 38 and the clutch plate 86 fit in the respective adjacent conical cavities 88*a*, 90*a* as seen in FIG. 3B, causing the clutch plate 86 to rotate with the main shaft 38. However, since the slide tube 84 is restrained from advancing and held in its retracted position by the balls 76, the clutch plate 86 is disengaged from the slide tube 84 and idly rotates without delivering the rotation of the main shaft 38 to the slide tube 84.

On the other hand, the rotation of reduced speed R1 of the support frame 44 of the main epicyclic train 36 drives the rotary member 64 through the balls 70 in FIG. 5 to deliver the torque to the output shaft 56.

The rotation of the output shaft 56 is smaller in the number of revolutions but larger in torque by an amount corresponding to the speed reduction achieved by the main train 36, than the resistance-free rotation thereof in the initial stage of tightening described.

The increased tightening torque is delivered to the inner socket 200 and the outer socket 180. At the ultimate stage of bolt-nut tightening, the torque causes stress concentration on the grooved portion C of the bolt for snapping off the tip T, whereby the tip T is sheared. This assures that the nut is tightened up on the bolt with a specified torque value.

DISCHARGE OF TIP AND RETURN OF PARTS

After tightening up, the cut-off bolt tip T remains in the inner socket 200 as retained by the plate spring 204. When the entire device is moved away from the nut N, the front end of the inner socket 200 is advanced into the nut fitting portion of the outer socket 180 and returned to its original position by the spring 206.

At this time, the ejector pin 240 remains in its retracted position as clamped by the clamp portion 218 of the clamp shaft 118.

When the tapered face 224 of the shaft 118 is moved away from the tapered face 228 of the support frame 172 by pulling the lever 120 and thereby retracting the shaft 118, the pin bore 220 of the shaft 118 enlarges to release the ejector pin 240 from the clamp portion, whereupon the ejector pin 240 is forced forward by the spring 242 to knock out the bolt tip T.

Further when the lever 120 is pulled, the stepped portion 130 of the shaft 118 retracts the slide block 112 of the clutch 74, whereby the balls 76 retained by the slide block 112 are allowed to retract into the bottomed bore of the shaft 118 to permit the advance of the slide tube 84.

When advanced by the spring 96, the slide tube 84 is brought into meshing engagement with the clutch plate 86 and brought to the original position, ready for the next tightening operation.

When the ejector pin 240 is damaged by a crack developing in its stepped portion, the ejector pin 240 needs to be repalced. For this procedure, the socket unit 176 is removed first by turning the socket holder main body 134 in the direction of arrow shown in FIG. 6B to register the hole 142 of the main body 134 with the hole 146 of the gear 144 as seen in FIG. 6A and render the socket unit free to slip off. The unit 176 is then easily removable. Next, the snap ring 178 is removed from the socket unit 176, and the transmission tube 190 is removed. The ejector pin 240 can then be removed.

ANOTHER EMBODIMENT FOR CLAMPING EJECTOR PIN

Figure 7A:
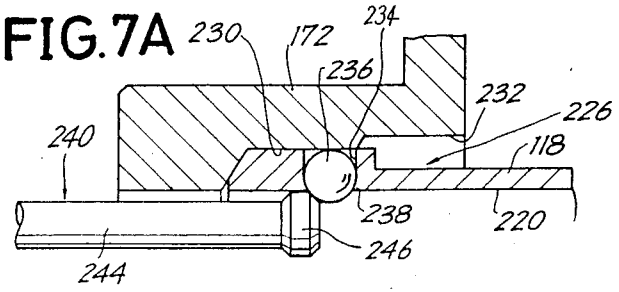
FIGS. 7A, 7B and 7C are views showing the operation of another embodiment of clamp portion in sequence.
Figure 7B:
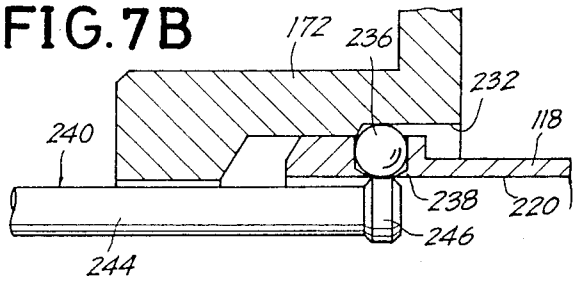
Figure 7C:
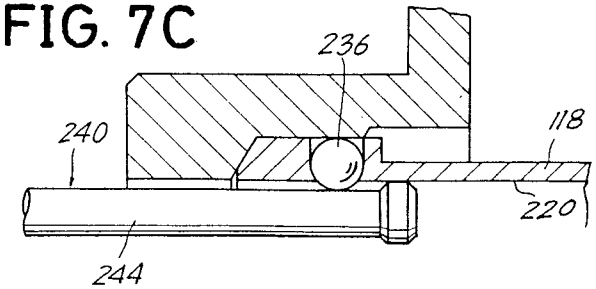
Figure 4:
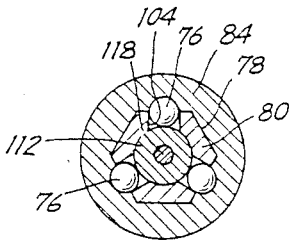
FIGS. 4 and 5 are views in section taken along the line IV—IV and line V—V in FIG. 1, respectively.

FIGS. 7A, 7B and 7C show another arrangement for clamping the ejector pin 240 in its retracted position. The planet gear support frame 172 is internally formed with a stepped bore 226 extending therethrough and including a small-diameter portion 230 and a large-diameter portion 232. The clamp shaft 118 is formed in the wall of its front end with one or a plurality of holes 234 each having a ball 236 fitted therein. Each of the holes 234 has an inner flange 238 at its bottom for preventing the ball 236 from falling off.

The ejector pin 240 has a diametrically enlarged rear end 246 which is closely fittable in the pin bore 220 of the clamp shaft 118 and a shank portion 244 of reduced diameter for permitting the ball 236 to drop in. When the ejector pin 240 is advanced into the pin bore 220 of the clamp shaft 118 by the insertion of a bolt tip T, the inner periphery of the support frame 172 defining the small-diameter bore portion 230 restrains the ball 236 from projecting outward, with the result that the enlarged rear end 246 comes into contact with the ball 236 projecting into the pin bore 220 to retract the clamp shaft 118.

Upon the ball 236 reaching the large-diameter bore portion 232 of the support frame 172, the ball 236 is forced outward by the ejector pin 240 as shown in FIG. 7B, permitting further retraction of the ejector pin 240. Upon the enlarged rear end 246 of the ejector pin 240 passing over the ball 236, the force of the spring 128 advances the clamp shaft 118 as seen in FIG. 7C, permitting projection of the ball 236 into the pin bore 220 of the shaft 118 again.

When the apparatus is removed from the nut N after the nut has been completely tightened up on the bolt, the inner socket 200 advances as already stated, but the ejector pin 240 is prevented from advancing by the ball 236.

Subsequently the lever 120 is manipulated to retract the clamp shaft 118, permitting outward projection of the ball 236 again, whereupon the ejector pin 240 is forced outward to its original position by the spring 242, discharging the tip.

In embodying the present invention, the transmission tube of the socket unit can be connected to the output shaft without using the auxiliary epicyclic trains, or an increased number of auxiliary epicyclic trains are usable to give a greatly increased torque.

According to the invention described above, the ejector pin is not connected to the lever directly but is coupled to the lever by a clamp shaft, so that the ejector pin can be shorter by an amount corresponding to the length of the clamp shaft and can therefore be accommodated in the socket unit. Accordingly the ejector pin is replaceable merely by removing the socket unit.

The embodiment described is not limitative but can be modified variously within the scope of the invention defined in the appended claims.

What is claimed is:

1. A bolt tightening apparatus comprising an epicyclic train including an internal gear and a planet gear support frame, an outer socket coupled to the internal gear, an inner socket coupled to the support frame, the two sockets being adapted to have fitted therein a nut and a tip at the front end of a bolt to shear the bolt tip by the reaction of rotation acting on the two sockets, and an ejector pin disposed in the inner socket for knocking out the bolt tip remaining in the inner socket, the outer socket and the inner socket being removably in engagement with the epicyclic train, the ejector pin having a rear end projecting from the rear end of the inner socket and extending into the support frame when in a retracted position, the epicyclic train being formed with a stepped axial bore extending therethrough in alignment with the ejector pin, a clamp shaft being axially slidably disposed in the axial bore and having a pin bore coaxial therewith and a clamp portion, the clamp portion being engageable with the stepped portion of the epicyclic train defining the axial bore to clamp the ejector pin when the ejector pin is inserted into the pin bore, the clamp shaft being coupled to a lever for retracting the clamp shaft to release the ejector pin from the clamp portion.

2. An apparatus as defined in claim 1 wherein the clamp portion has at least one slit open at the front end of the clamp shaft and communicating with the pin bore, and the clamp shaft is formed with a tapered face at its front end, the epicyclic train being formed with a tapered face defining the stepped portion of the axial bore and corresponding to the tapered face of the clamp shaft.

3. An apparatus as defined in claim 1 wherein a hole is formed in the peripheral wall of the clamp shaft in communication with the pin bore, and the clamp portion comprises a ball having a diameter larger than the thickness of the peripheral wall and rollably fitted in the hole, the stepped axial bore including a large-diameter portion for permitting escape of the ball and a small-diameter portion for restraining the ball inwardly of the clamp shaft, the ejector pin having a diametrically enlarged rear end engageable with the ball.

* * * * *